US006312372B1

(12) United States Patent
Larsson et al.

(10) Patent No.: US 6,312,372 B1
(45) Date of Patent: Nov. 6, 2001

(54) OUTLET OF A CENTRIFUGAL SEPARATOR HAVING A REACTION DRIVEN ROTOR

(75) Inventors: Leif Larsson; Ingvar Hällgren, both of Tumba (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/623,301

(22) PCT Filed: Jan. 27, 2000

(86) PCT No.: PCT/SE00/00168

§ 371 Date: Oct. 23, 2000

§ 102(e) Date: Oct. 23, 2000

(87) PCT Pub. No.: WO00/44502

PCT Pub. Date: Aug. 3, 2000

(30) Foreign Application Priority Data

Jan. 27, 1999 (SE) ..... 9900257

(51) Int. Cl.[7] ..... B04B 9/06
(52) U.S. Cl. ..... 494/49
(58) Field of Search ..... 494/24, 36, 43, 494/49, 60, 64, 65, 67, 84, 901; 210/168, 171, 232, 360.1, 380.1, 416.5; 184/6.24

(56) References Cited

U.S. PATENT DOCUMENTS 1,720,475 * 7/1929 Hewitt .
2,485,390 10/1949 Langmuir .
3,432,091 * 3/1969 Beazley ..... 494/49
3,666,170 * 5/1972 Cacciabue et al. .
4,615,315 * 10/1986 Graham ..... 184/6.24
5,674,392 * 10/1997 Christophe et al. ..... 494/49
5,975,245 * 11/1999 Jephott et al. ..... 184/6.24
6,058,899 * 5/2000 Schetter ..... 184/6.24

FOREIGN PATENT DOCUMENTS

1097370 * 1/1961 (DE) ..... 494/49
254356 * 1/1988 (EP) ..... 494/49
272727 * 6/1970 (SU) ..... 494/49
535961 * 11/1976 (SU) ..... 494/49
1158242 * 5/1985 (SU) ..... 494/49
9612549 5/1996 (WO) .

* cited by examiner

*Primary Examiner*—Charles E. Cooley
(74) *Attorney, Agent, or Firm*—McCormick, Paulding & Huber LLP

(57) ABSTRACT

The invention relates to an apparatus for the separation of contaminants from a pressurized liquid. Specifically, the apparatus is a centrifugal rotor adapted to be reaction driven by the pressurized liquid arranged within a housing. The housing has an outlet that is oriented in a direction substantially opposite the direction of rotation of the rotor to make it easier for the liquid to leave the housing.

9 Claims, 1 Drawing Sheet

OUTLET OF A CENTRIFUGAL SEPARATOR HAVING A REACTION DRIVEN ROTOR

FIELD OF THE INVENTION

The present invention relates to a centrifugal separator including a stationary housing, which forms a chamber, and a rotor arranged in the chamber, the rotor being rotatable in a predetermined rotational direction around a rotational axis and adapted for its rotation to receive pressurized liquid and to discharge at least part of this liquid through at least one rotor outlet, situated at a distance from the rotational axis, in a direction such that the rotor is subjected to a reaction force in its circumferential direction as a consequence of outflowing liquid, said chamber being surrounded by a surrounding wall, which constitutes part of the housing and is provided with at least one outlet for liquid.

BACKGROUND OF THE INVENTION

In a centrifugal separator of this kind, known for instance through WO 96/12549, it is desired that the stationary housing is only insignificantly larger than the rotor. Thereby, the air resistance to the rotor rotation within the housing can be made as small as possible. Furthermore, within a given space for the whole centrifugal separator the rotor can, thereby, be made as large as possible and, thus, get a capacity as large as possible.

A circumstance making it difficult to have the stationary housing only insignificantly larger than the rotor is that liquid having left the rotor requires a certain space within the housing around the rotor Particularly if the rotor, as in a preferred embodiment of the present invention, is arranged with its rotational axis extending substantially horizontally, the housing can not be made too small. The reason for this is that part of said surrounding wall in this case forms a bottom of the chamber and that liquid, thereby, may collect and form a pool on this bottom, before it runs out through the outlet in the surrounding wall.

The present invention has for its object to avoid the above described difficulty and to make possible that the housing is made only insignificantly larger than the rotor.

This object can be obtained in that the outlet in the surrounding wall is formed in a way such that liquid is allowed to leave the chamber in a direction substantially opposite to the rotational direction of the rotor. An outlet formed in this way creates possibilities for the liquid to rapidly leave the chamber without forming a space-requiring pool therein, which may disturbed the rotation of the rotor. The invention builds on the circumstance that liquid leaving the rotor gets a component of movement in a direction opposite to the rotational direction of the rotor, not only seen in relation to the rotor but also seen in relation to the housing surrounding the rotor.

Thanks to the invention it becomes possible to arrange the centrifugal separator with the rotational axis of its rotor forming an angle with a vertical axis—even extending horizontally—without the housing around the rotor having to be made substantially larger than the rotor. It is particularly suitable to have the rotor outlet situated at one axial end of the rotor and the outlet in the surrounding wall situated at substantially the same axial level in the chamber as the rotor outlet.

For further acceleration of the liquid outflow from the chamber said surrounding wall preferably extends substantially circularly around the rotor and has, at least along part of its extension axially along the rotor, an increasing diameter in a direction towards the outlet in the surrounding wall.

BRIEF DESCRIPTION OF THE DRAWINGS

The invention is described in the following with reference to the accompanying drawing, in which the FIGS. 1 and 2 show a centrifugal separator according to the invention in an axial section and in a section across the rotational axis of the rotor, respectively.

DETAILED DESCRIPTION OF THE PREFERRED EMBODIMENT

Figure 1:
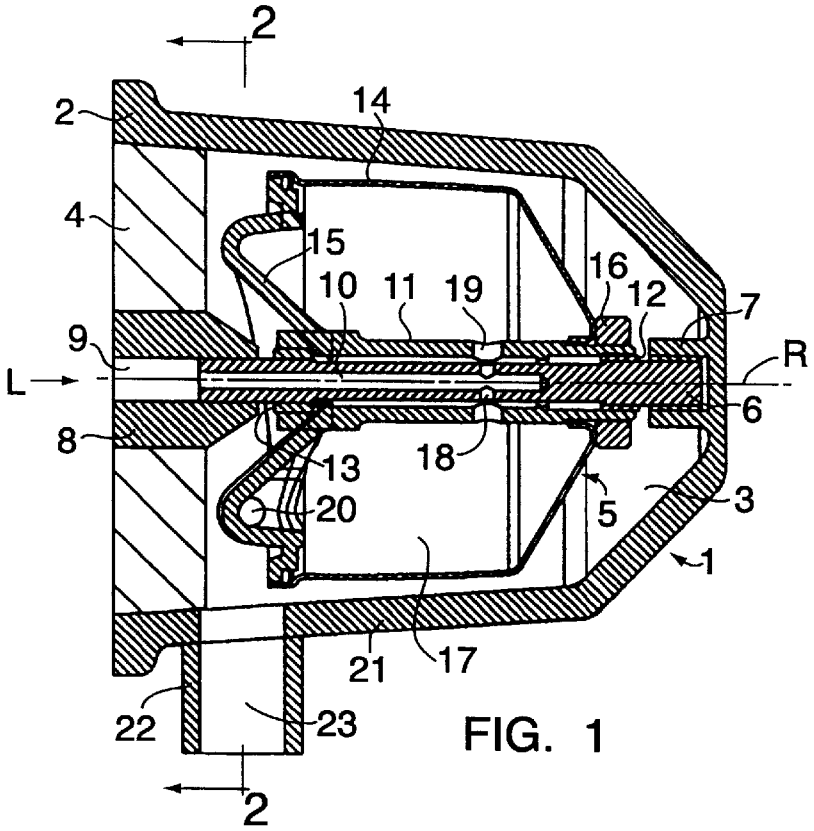
FIG. 1. is a cross-sectional, side elevational view of a separator embodying the present invention, the section being taken along line 1—1 as shown in FIG. 2.

A centrifugal separator according to the invention may be used, for instance, connected with a self cleaning filter of the kind shown in WO 96/12549. Then, the centrifugal separator is adapted to be charged with pressurized oil containing solid particles, which have first been separated by means of said filter and then have been transported to the centrifugal separator by return rinsing of successive parts of the filter by means of cleaned oil still subjected to an overpressure. For a closer description of the self cleaning filter reference is made to WO 96/12549.

The centrifugal separator shown in the drawing is presumed to be connected with a filter of the kind shown in WO 96/12549. Differing however from the arrangement in WO 96/12549, the filter as well as the centrifugal separator in the arrangement here concerned are arranged with a horizontal rotational axis for their respective rotational components. Thus, the centrifugal separator shown in FIG. 1 has a stationary housing 1, which through annular flange 2 is connected with a housing (not shown) belonging to the aforementioned filter. The stationary housing 1 delimits a chamber 3, and an end wall 4 at one end of the housing 1 the end wall constituting a partition between the chamber 3 and the interior of said filter.

Within the chamber 3 there is arranged a rotor 5 rotatable around a horizontal rotational axis R. The rotor 5 is supported by a horizontal supporting shaft 6, which at one of its ends is journalled in a sleeve connected with the stationary housing 1 and at its other end is connected with a central member 8. The central member 8, which in this case is constituted by a component of the self cleaning filter, is slowly rotatable around the horizontal rotational axis R of the rotor 5 and has a channel 9 through which pressurized oil, designated by the symbol L, should be transferred from the filter (not shown) to the shown centrifugal separator. The horizontal supporting shaft 6 of the rotor 5, which extends into the channel 9, has along part of its extension a central inlet channel 10 adapted to conduct oil L from the channel 9 into the rotor 5.

The rotor 5 includes a central sleeve 11, which surrounds part of the horizontal supporting shaft 6 and through axially spaced slide bearings 12 and 13 is journalled thereon. Furthermore, the rotor 5 includes a casing 14 and an end wall 15, which are held connected with each other and with the central sleeve 11 by means of a ring 16. The casing 14 and the end wall 15 delimit a separator chamber 17 in the rotor 5. The horizontal supporting shaft 6 and the central sleeve 11 have holes 18 and 19, respectively, situated opposite to each other for conducting oil from the control inlet channel 10 into the separation chamber 17.

The end wall 15 of the rotor 5 has two rotor outlets 20 for oil having been freed from particles in the separation chamber 17. The rotor outlets 20 are formed as nozzles and are situated at the same distance from but on diametrically opposite sides of the rotational axis R and are facing substantially in the circumferential direction of the rotor 5 as can be seen from FIG. 2.

Still referring to FIG. 1, the stationary housing 1 has a surrounding wall 21, which delimits the chamber 3 and concentrically surrounds the rotor 5. The surrounding wall 21 at a level lower than that of the rotor 5 has an outlet 22 forming an outlet channel 23. The outlet channel 23 extends from the chamber 3 tangentially out through the surrounding wall 21 in a direction substantially opposite to the rotational direction 24 of the rotor 5.

In operation of the above described centrifugal separator pressurized liquid, e.g. oil, supplied to the rotor 5 through the central inlet channel 10 will leave the rotor through the rotor outlets 20. The speed by which liquid leaves the rotor 5 may be for instance 45 m/s. By the reaction force given to the rotor by the outflowing liquid the rotor 5 may be caused to rotate and be kept in rotation by a speed such that the rotor outlets 20 may move at a speed of for instance 30 m/s.

This means that the liquid leaving the rotor 5 may move relative to the stationary housing 1 at a speed of for instance 15 m/s in a direction opposite to the rotational direction 24 of the rotor 5. There will then come up a liquid flow in the chamber 3 along the surrounding wall 21 around the rotational axis R of the rotor 5. For facilitating outflow of the liquid from the chamber 3, the outlet channel 23 in the outlet 22, therefore, extends as previously described out of the chamber 3 in a direction substantially opposite to the rotational direction 24 of the rotor 5. Thereby, to the greatest possible degree it is avoided that the liquid is collected in the chamber 3 and forms a pool therein, which may impede rotor rotation.

The outlet channel 23 may have any suitable cross sectional form. It may for instance, at least at its opening in the chamber 3, have a larger extension along the rotational axis R of the rotor 5 than in the circumferential extension direction of the rotor 5. Possibly, said outlet channel 23 extends not only in an area axially at the same level as the rotor end wall 15, i.e. in the area of the rotor outlets 20, but also some distance along the casing 14 of the rotor 5.

As can be seen from FIG. 1, the surrounding wall 21 of the stationary housing 1, which extends circularly around the rotor 5, has a form such that along its extension axially along the rotor 5 it has an increasing diameter in a direction towards the outlet channel 23. Even this contributes to preventing formation of a liquid pool at the bottom of the chamber 3 of the stationary housing 1 in the area of the rotor 5.

Particles to be separated in the separation chamber 17 are collected at the inside of the casing 14. Intermittently, the centrifugal separator has to be taken out of operation and be disassembled for removal of such particles.

It should be observed that said horizontal supporting shaft 6 in the shown arrangement rotates relative to the stationary housing 1 during operation of the centrifugal separator. Hereby is achieved that there is no risk, e.g. at a relatively slow rotation of the rotor 5, that the bearings 12 and 13 or the horizontal supporting shaft 6 would be unevenly worn as a consequence of the one-sided load of the rotor 5 on the horizontal supporting shaft 6 because the rotational axis R of the rotor is horizontal. The rotation of the horizontal supporting shaft 6, thus, has a special meaning when it extends horizontally.

Figure 2:
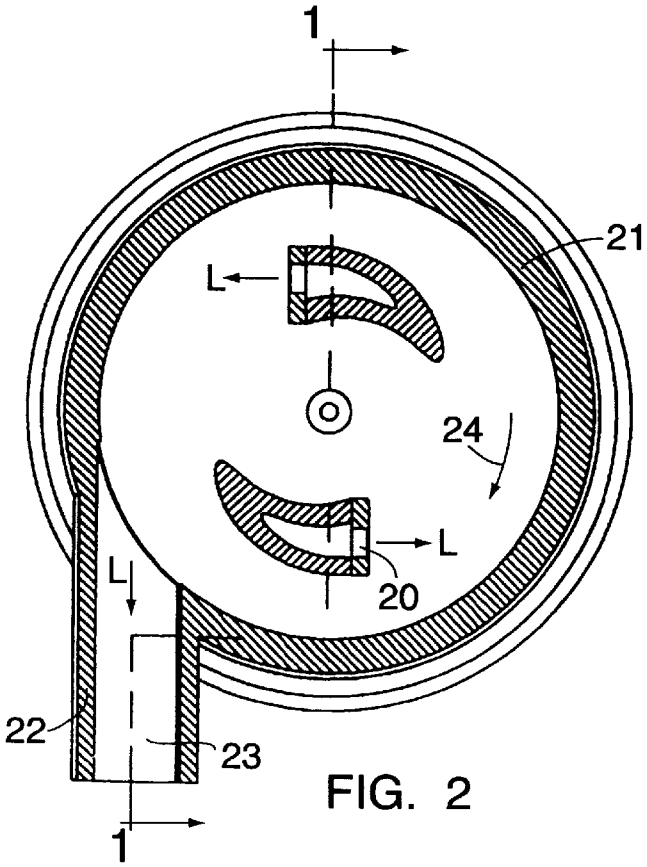
FIG. 2 is a cross-sectional view of the apparatus of FIG. 1 taken along line 2—2.

In the arrangement according to the FIGS. 1 and 2 the outlet channel 23 of the stationary housing 1 extends vertically and tangentially out of the chamber 3. To avoid that liquid would be left at the bottom of the chamber 3, when the centrifugal separator is taken out of operation, the stationary housing 1 may be turned somewhat counter-clockwise from the position that can be seen in FIG. 2. Hereby, the part of the outlet channel 23 situated closest to the chamber 3 will be situated at the very lowermost part of the chamber 3, so that all liquid may run out thereof.

What is claimed is:

1. A centrifugal separator including a stationary housing (1), which forms a chamber (3), and a rotor (5) arranged in the chamber, the rotor being rotatable in a predetermined rotational direction around a rotational axis (R) and adapted for its rotation to receive pressurized liquid and to discharge at least part of this liquid through at least one rotor outlet (20), situated at a distance from the rotational axis (R), in a direction such that the rotor is subjected to a reaction force in its circumferential direction as a consequence of outflowing liquid, said chamber (3) being surrounded by a surrounding wall (21), which constitutes part of the housing and is provided with at least one outlet (22,23) for the liquid, said outlet (22, 23) extending outwardly from said surrounding wall in a direction substantially opposite the direction of rotation of said rotor (5) such that said liquid leaving said chamber (3) flows in substantially the same direction along which it was moving within said chamber (3).

2. A centrifugal separator according to claim 1, in which the surrounding wall (21) has a substantially circular cross section and surrounds the rotor (5) substantially concentrically.

3. A centrifugal separator according to claim 1, in which the outlet (22,23) in the surrounding wall (21) is situated at substantially the same axial level in the chamber (3) as the rotor outlet (20).

4. A centrifugal separator according to claim 3, in which the rotor outlet (20) is situated at one axial end of the rotor (5).

5. A centrifugal separator according to claim 1, in which the rotor (5) is arranged with its rotational axis (R) forming an angle with a vertical axis.

6. A centrifugal separator according to claim 5, in which the rotational axis (R) of the rotor (5) extends substantially horizontally.

7. A centrifugal separator according to claim 6, in which the outlet (22,23) in the surrounding wall (21) is situated at a level lower than that of the rotor (5).

8. A centrifugal separator according to claim 1, in which said surrounding wall (21) extends substantially circularly around the rotor (5) and, along at least part of its extension axially along the rotor (5), has an increasing diameter in the direction towards the outlet (22,23) in the surrounding wall (21).

9. A centrifugal separator according to claim 1, in which said outlet (22, 23) is tangential with the surrounding wall (21).

* * * * *